US005624786A

United States Patent [19]

Hirabayashi et al.

[11] Patent Number: 5,624,786

[45] Date of Patent: Apr. 29, 1997

[54] PHOTOGRAPHIC IMAGE FORMING METHOD

[75] Inventors: Kazuhiko Hirabayashi; Takeshi Sampei, both of Hino, Japan

[73] Assignee: Konica Corporation, Tokyo, Japan

[21] Appl. No.: 440,078

[22] Filed: May 12, 1995

[30] Foreign Application Priority Data

May 18, 1994 [JP] Japan ..... 6-103981

[51] Int. Cl.[6] ..... G03C 1/06

[52] U.S. Cl. ..... 430/264; 430/598; 430/401; 430/434; 430/435; 430/449; 430/455; 430/463; 430/464; 430/613; 430/614; 430/510; 430/517; 430/522

[58] Field of Search ..... 430/264, 598, 430/613, 614, 401, 434, 435, 449, 455, 463, 464, 510, 517, 522

[56] References Cited

U.S. PATENT DOCUMENTS 5,208,137 5/1993 Usagawa et al. ..... 430/522

5,352,563 10/1994 Kawasaki ..... 430/264

5,368,984 11/1994 Yoshida ..... 430/264

*Primary Examiner*—Geraldine Letscher

*Attorney, Agent, or Firm*—Frishauf, Holtz, Goodman, Langer & Chick, P.C.

[57] ABSTRACT

An image forming method is disclosed, comprising exposing a silver halide photographic material through a transparent, high definition-screening original and developing the photographic material with a developer to form a halftone dot image, wherein:

the photographic material forms a halftone dot image having a dot area of 57% or less when exposed, through the transparent original comprising a halftone dot image having a dot area of 50%, in two times an amount that gives a halftone dot having a dot area of 50%; and the photographic material has a maximum density of 3.0 or more and a contrast of 8.0 or more;

and wherein the photographic material is exposed to light having an emission peak at a wavelength of 360 to 450 nm and developed with a developer having a pH of 10.5 or less.

5 Claims, No Drawings

PHOTOGRAPHIC IMAGE FORMING METHOD

INDUSTRIAL FIELD OF THE INVENTION

The present invention relates to an image forming method of a silver halide photographic light sensitive material and especially to an image forming method for obtaining a high contrast, high definition photographic image by use of a silver halide photographic light sensitive material containing a hydrazine compound or a tetrazolium compound.

BACKGROUND OF THE INVENTION

Recently, there have been actively undertaken research and development of high definition printing in the field of printing arts. Ordinary printed-pictures are comprised of halftone dots having a line-number of 175 lines per inch, which are liable to produce a moire or Roset pattern. To avoid these problems and make a printed image close to a photographic image, there have increased high definition prints having a high screen frequency. (Hereinafter, unless otherwise noted, the high definition printing material indicates one comprised of a screen frequency of 400 lines/inch or more.)

In printing a conventional roomlight-handling photographic material in contact with a film which has been printed by a scanner, for example, at 600 lines/inch, the dot percentage is excessively increased before reaching a required density because contrast thereof is liable to be varied. Accordingly, in printing further on a presensitized plate, if an original dot density is low, no small dot is produced so that an unnatural image was produced. Liability to contrast variation becomes larger with an increase of the line number because variation of dot percentage versus exposure amount becomes larger due to increased total circular length of dots.

In the high definition printing, a small dot area is smaller and a minimum density portion of a large dot becomes smaller, as compared to the case of printing at 175 lines/inch. Accordingly, in a low contrast photographic material, a density of the small dot is lowered and a large dot becomes filled-in so that an exposure latitude becomes narrow. Therefore, in a contact printing process of high definition screening printing, there has been desired a roomlight handling material having a high contrast and little liability to variation thereof.

Processing of a silver halide photographic material is carried out conventionally by use of a automatic processor with replenishing of processing solutions from the viewpoints of stability, rapidness, easiness and handling. In a developer for processing a black and white photographic material, dihydroxybenzenes have been employed as a developing agent. In practice, the dihydroxybenzenes have been advantageously used for development of most black and white photographic material from the view points of photographic activity, stability, availability, handling and cost. However, the dihydroxybenzenes are undesirable for human body as they are allergic.

Therefore, there has been strongly desired development of a developer free from the dihydroxybenzenes. U.S. Pat. No. 5,236,816, for example, discloses a developer containing ascorbic acid in place of the dihydroxybenzene.

Photographic processing waste liquor is not allowed to be released to a public sewer since it contains an undesirable component; therefore, the waste liquor is collected and subjected to decomposition treatment by a troublesome and expensive combustion technique. In view thereof, there has been desired reduction of photographic processing waste liquor. As a means for solving these problems, there was proposed reduction of a replenishing amount in processing with a processor. However, the reduction of the replenishing amount tends to accumulate unnecessary reaction products resulted from processing in a processing bath of the processor. Particularly, a silver salt dissolved out from a photographic material precipitates on the surface of the photographic material to form metalic silver, which causes stain due to so-called silver sludge.

There has been desired a lower replenishing rate from the view points of low cost and low waste liquor. The processing amount per day of roomlight films is much larger than that of photographic films for camera and scanner so that super-rapid processing has been demanded. However, processing at a low replenishing rate or super-rapid processing has led to deterioration in processing stability.

SUMMARY OF THE INVENTION

An object of the present invention is to provide a roomlight-handling photographic material and an image forming method therewith, which are excellent in processing stability, halftone dot quality and improved in safelight safety characteristics even when processed with a developer having a pH of 10.5 or less in a contact-printing process of a high definition printing material.

The above object can be accomplished by an image forming method comprising exposing a silver halide photographic material in contact with a transparent, high definition screening halftone original and developing the photographic material with a developer to form a halftone dot image, the photographic material comprising a support having thereon photographic component layers including a silver halide emulsion layer, wherein:

when the photographic material is exposed, through a transparent original comprising halftone dots having a dot percentage of 50%, in two times an exposure amount that gives halftone dots having a dot percentage of 50% and developed, the photographic material forms halftone dots having a dot percentage of 57% or less; and when exposed through an optical wedge and developed, the photographic material has a maximum density of 3.0 or more and a contrast of 8.0 or more; and wherein the photographic material is exposed to light from a light source having an emission peak at a wavelength of 360 to 450 nm and developed with a developer having a pH of 10.5 or less.

DETAILED DESCRIPTION OF THE INVENTION

In the image forming method of the invention, it is preferable that the photographic material is processed under the conditions specified below; Conditions of development and subsequent processing:

| Step | Temperature | Time |
|---|---|---|
| Developing | 28° C. | 30 sec. |
| Fixing | 28° C. | 20 sec. |
| Washing | Ordinary temperature | 15 sec. |

-continued

| Drying | 40° C. | 35 sec. |
|---|---|---|
| | Developer | |
| Composition A | | |
| Deionized water | | 150 ml |
| Sodium ethlenediaminetetraacetate | | 2 g |
| Diethylene glycol | | 50 g |
| Potassium sulfite (55% solution) | | 100 ml |
| Potassium carbonate | | 50 g |
| Hydroquinone | | 15 g |
| 5-Methylbenzotriazole | | 200 mg |
| 1-Phenyl-5-mercaptotetrazole | | 30 mg |
| Potassium bromide | | 4.5 g |
| Composition B | | |
| Deionized water | | 3 ml |
| Diethylene glycol | | 50 mg |
| Sodium ethlenediaminetetraacetate | | 25 mg |
| Acetic acid (90% aq. solution) | | 0.3 ml |
| 5-Nitroindazole | | 110 mg |
| 1-Phenyl-3-pyrazolidone | | 500 mg |

where compositions A and B are dissolved in 500 ml of water and water is further added thereto to make 1 liter, and the pH of the developer is adjusted to 10.4.

| Fixer | |
|---|---|
| Composition A: | |
| Ammonium thiosulfate (72.5 aq. solution) | 230 ml |
| Sodium sulfite | 5.6 g |
| Sodium acetate trihydrate | 27.8 g |
| Boric acid | 9.8 g |
| Sodium citrate dihydrate | 2.0 g |
| Acetic acid (90% aq. solution) | 6.4 ml |
| Composition B | |
| Deionized water | 28 ml |
| Sulfuric acid (50% solution) | 6.7 g |
| Aluminium sulfate | 25.31 g |

where compositions A and B are dissolved in 500 ml of water and water is further added thereto to make 1 liter, and the pH of the fixer is adjusted to 4.4.

In the invention, the high definition screening halftone original is, for example, comprised of halftone dot image prepared by means of a scanner having a screen frequency of 350 to 1500 lines/inch, preferably 400 to 900 lines/inch. A photographic light sensitive material is exposed through a transparent halftone original having a screen frequency of 600 lines/inch, for example, in such a manner that a silver image-having side of the original is allowed to be in contact with a silver halide emulsion layer-having side of the photographic light sensitive material. When exposed through an original having a dot area of 50% in two times a light-exposing amount that gives a halftone dot image having a dot area of 50%, if the resulting halftone image has a dot area of more than 57%, it is not preferable since the exposure latitude becomes narrow due to its high gradation. In the case when the dot percentage is not more than 57% (preferably, 55% or less), fluctuations in the dot percentage due to the fluctuation in exposure fall within a allowable range.

In the present invention, the photographic light sensitive material is exposed to light having an emission peak at a wavelength of 360 to 450 nm. As a light source having an emission peak at a wavelength of 360 to 450 nm, is cited a high-pressure mercury lamp, carbon-arc lamp, pulsed xenon lamp or metal-halide lamp.

In the invention, the use of a dye is effective in improving the above-described problems. Particularly, it is preferable to add the dye dispersed in the form of solid fine particles because diffusion thereof to another layer is prevented. The solid particle dispersion of the dye may be added to a emulsion layer or backing layer, preferably a emulsion layer. It may be added to both of an emulsion layer and a protective layer other than the emulsion layer, preferably only to the protective layer.

In the present invention, it is preferable that at least one of the component layers of the silver halide photographic light sensitive material contains a compound represented by the following formulas [1] through [6],

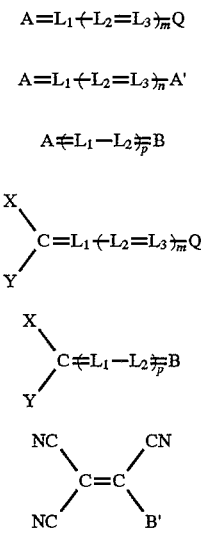

formula [1]

formula [2]

formula [3]

formula [4]

formula [5]

formula [6]

wherein A and A', which may be the same with or different from each other are an acidic nucleus; Q is an aryl group or heterocyclic group; B is a basic group; B' is a heterocyclic group; X and Y, which may be the same with or different from each other are each an electron-attractive group; $L_1$, $L_2$ and $L_3$ are each a methine group; m is 0 or 1; n is 0, 1 or 2; p is 1 or 2, provided that a compound represented by formulas [1] through [6] contains, in a molecule thereof, at least one group selected from a carboxy group, sufonamide group and sulfamoyl group.

Compounds represented by formulas [1] through [6] including examples thereof and a preferable dispersing method will be explained as below, but the present invention is not limited thereto.

An aryl group represented by Q in above-described formulas [1] and [4] includes, for example, a phenyl or naphthyl group. A heterocyclic group represented by Q includes, for example, a pyridine, quinoline, isoquinoline, pyrrol, pyrazole, imidazole and indole residue.

The aryl group and heterocyclic group may be substituted; and examples of a sustituent thereof include an alkyl group, cycloalkyl group, aryl group, halogen atom, alkoxycarbonyl group, aryloxycarbonyl group, carboxy group, cyano group, hydroxy group, mercapto group, amino group alkoxy group, aryloxy group, acyl group, carbamoyl group, acylamino group, ureido group, sulfamoyl group and sulfonamide group, and two or more of these groups may be employed in combination therewith. Preferable is an alkyl group having 1 to 6 carbon atoms (such as a methy group, ethyl group, butyl group or 2-hydroxyethyl group), hydroxy, halogen atom (such as fluorine or chlorine atom), alkoxy group (such as a methoxy group, ethoxy group, methylenedioxy group, 2-hydroxyethoxy group or n-butoxy), substituted amino group (such as a dimethylamino group, diethylamino group, di-(n-butyl)amino group, N-ethyl-N-hydroxyethylamino group, N-ethyl-N-methane-methanesulfonamidoethylamino group, morpholino group, piperidino group or pyrrolidino group), carboxy group, sulfonamide group (such as methanesulfonamide group or benzenesulfonamide group) or sulfamoyl group (such as a sulfamoyl group, methylsulfamoyl group or phenylsulfamoyl group.

An acidic nucleus represented by A and A' of formulas [1], [2] and [3] includes preferably a 5-pyrazolone, barbituric acid, thiobarbituric acid, rhodanine, hydantoin, thiohydantoin, oxazolone, isooxazolone, indanedione, pyrazolidinedione, oxazolidinedione, hydroxypyridone or pyrazolopyridone nucleus.

A basic nucleus presented by B of formulas [3] and [5] includes preferably a pyridine, quinoline, oxazole, benzooxazole, naphthooxazole thiazole, benzothiazole, naphthothiazole, indolenine, pyrrol or indole nucleus.

An electron-attractive group represented by X and Y of formulas [4] and [5], which may be the same with or different from each other includes preferably a cyano group, alkoxycarbonyl group, aryloxycarbonyl group, carbamoyl group, carboxy group, acyl group, alkylsulfonyl group, arylsulfonyl group or sulfamoyl group.

A heterocyclic group represented by B' of formula [6] includes a pyridine, pyridazine, quinoline, pyrrol, pyrazole, imidazole or indole ring group.

A methine group represented by $L_1$, $L_2$ and $L_3$ of formulas [1] through [5] may be substituted, and as a substituent thereof is cited, for example, an alkyl group having 1 to 6 carbon atoms (such as methyl, ethyl, propyl or isobutyl), aryl group (such as phenyl, p-tolyl or p-chlorophenyl), alkoxy group having 1 to 4 carbon atoms (methox or ethoxy), aryloxy group (such as phenoxy), aralkyl group (such as benzyl or phenethyl), heterocyclic group (pyridyl, furyl or thienyl), substituted amino group )such as dimethylamiono, tetramethylene amino or anilino) or alkylthio (such as methylthio).

Examples of dye compounds of formulas [1 ] through [6 ] are shown as below.

1-1

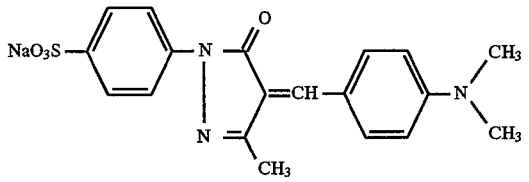

1-2

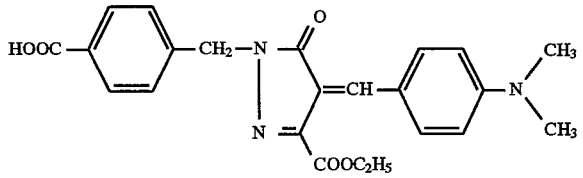

1-3

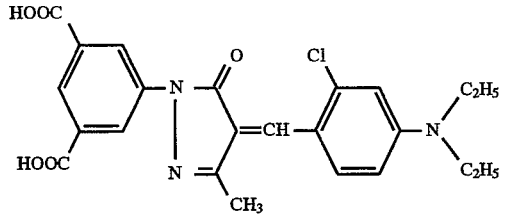

1-4

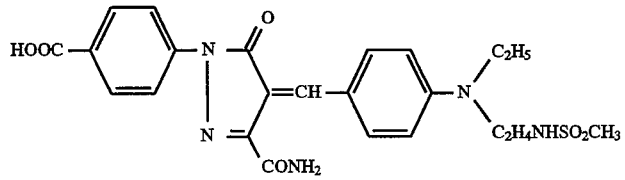

1-5

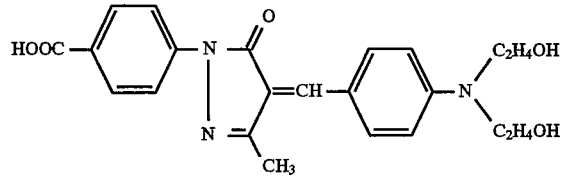

1-6

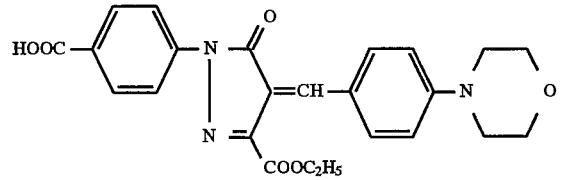

-continued
1-7
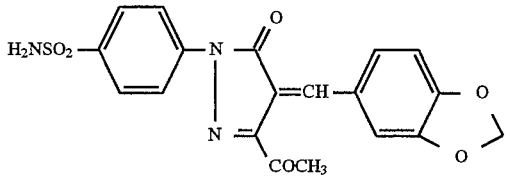
1-8
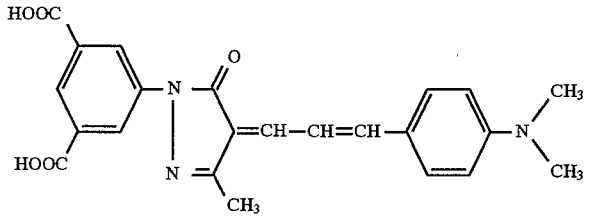
1-9
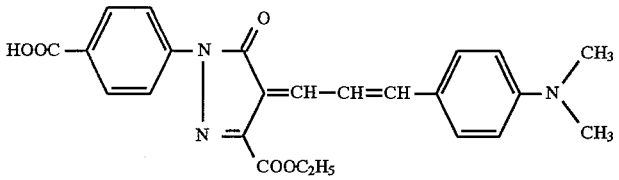
1-10
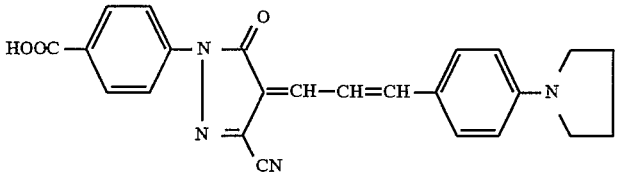
1-11
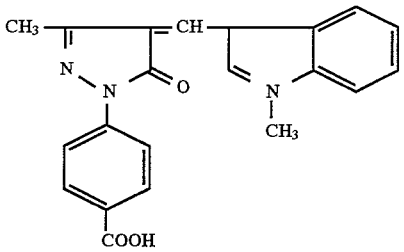
1-12
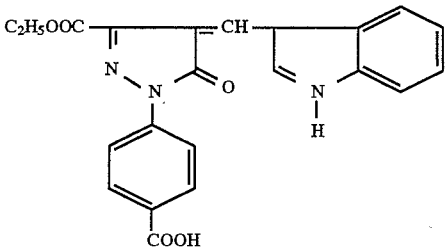
1-13
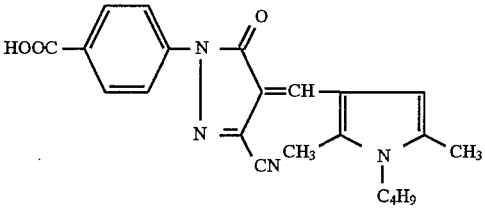

-continued
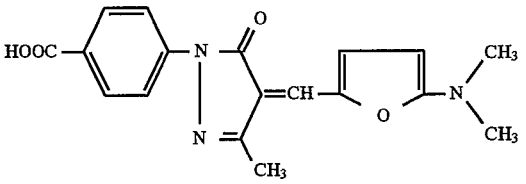
1-14
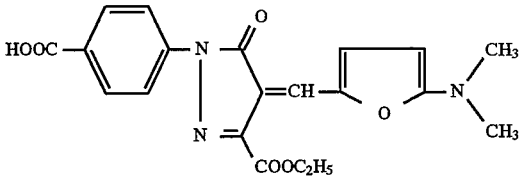
1-15
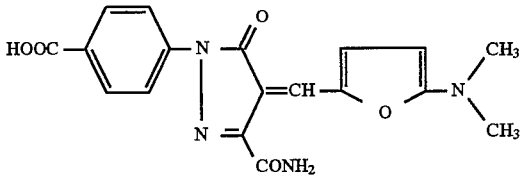
1-16
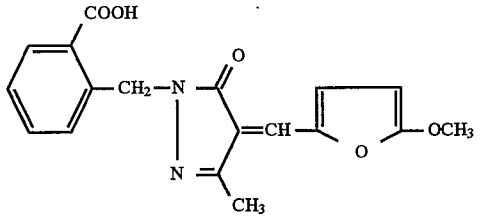
1-17
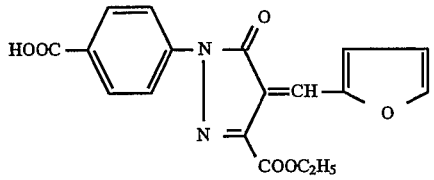
1-18
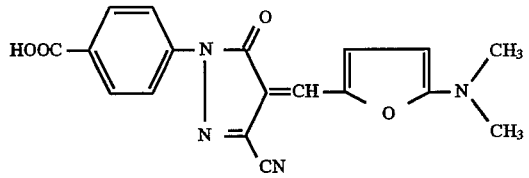
1-19
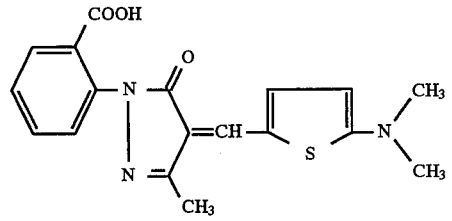
1-20
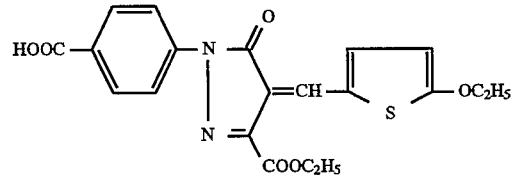
1-21

-continued
1-22
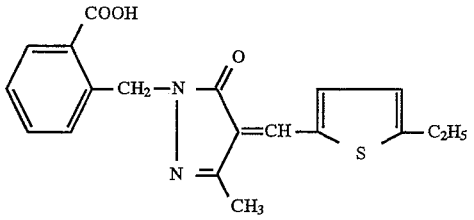
1-23
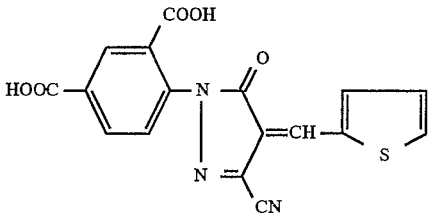
2-1
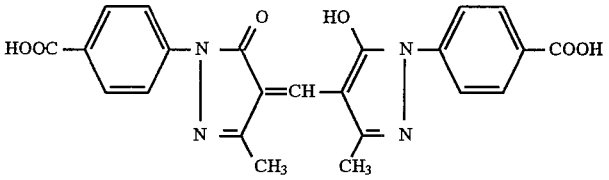
2-2
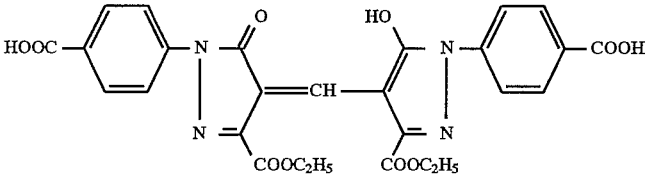
2-3
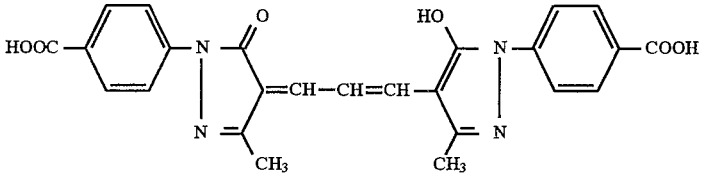
2-4
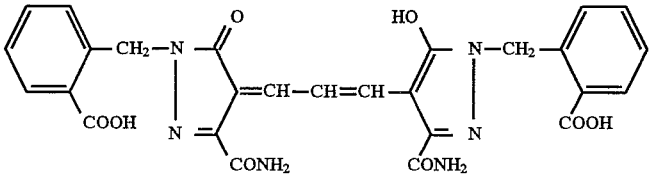
2-5
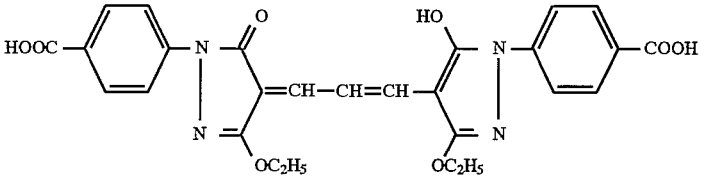
3-1
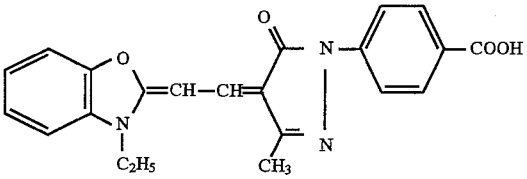

-continued
3-2
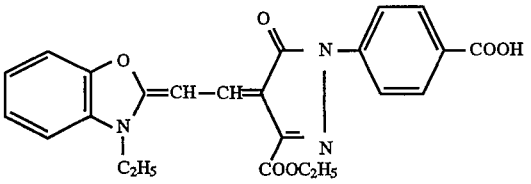
3-3
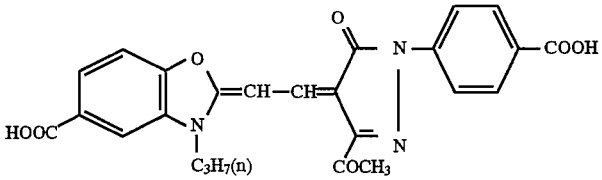
3-4
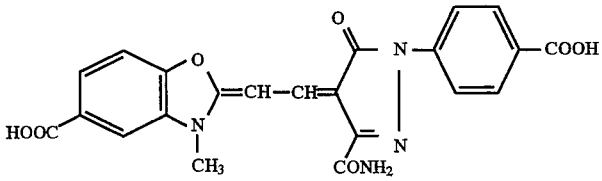
3-5
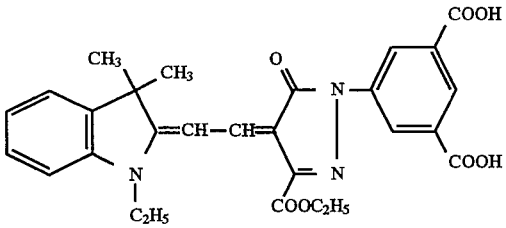
4-1
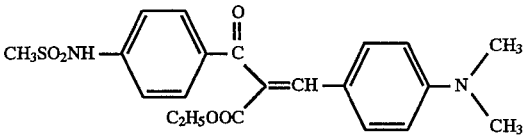
4-2
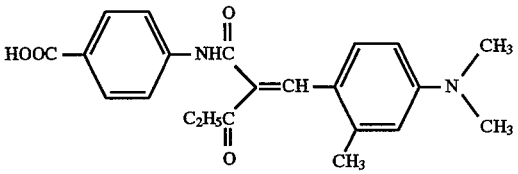
4-3
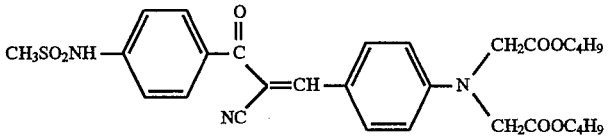
4-4
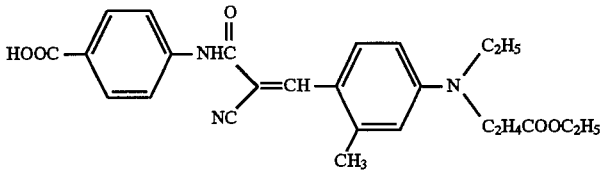
4-5
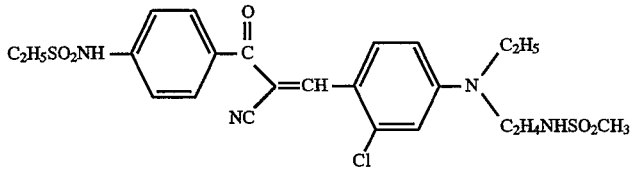

-continued
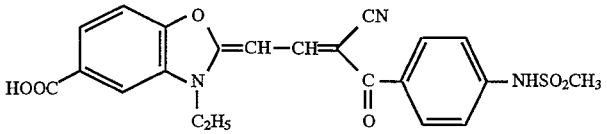
5-1
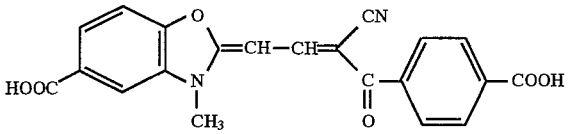
5-2
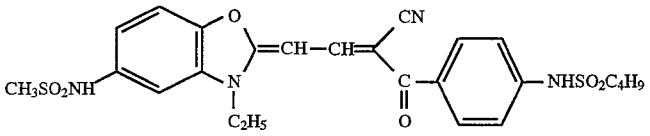
5-3
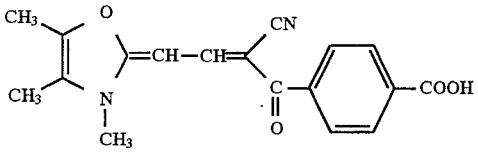
5-4
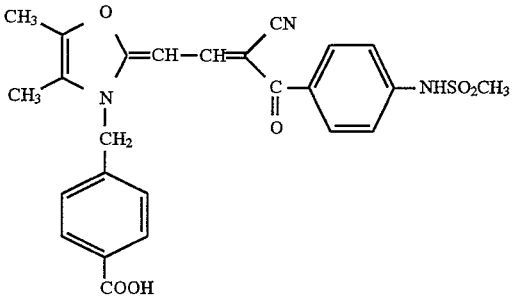
5-5
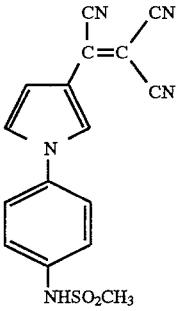
6-1
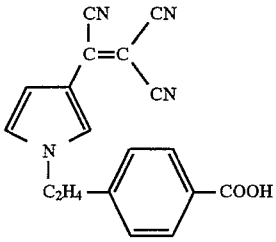
6-2

-continued

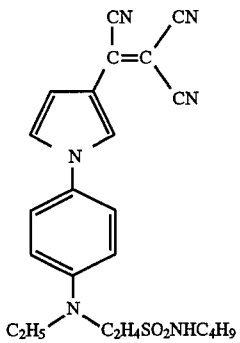

6-3

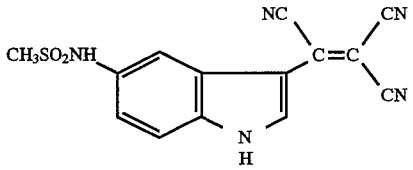

6-4

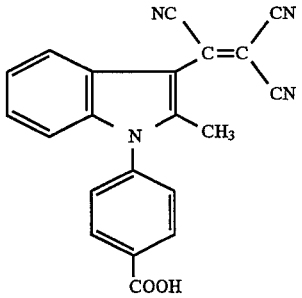

6-5 in the invention, a dye compound of formulas [1] through [6] is preferably added in the form of a dispersion of solid particles. To disperse the dye of formulas [1] through [6], for example, is applicable acidic precipitation process or dispersion by means of ball mill, jet mill or impeller.

In the invention, an average size of fine particles of a dye dispersed in the form of solid particle dispersion is optimal, preferably 0.01 to 20 μm, and more preferably 0.03 to 2 μm. A variation coefficient of particle size distribution of the dye is preferably 60% or less and more preferably, 40% or less.

Fine particles of the dye of the invention may be contained in any of layers of a photographic element. In the case when contained in a silver halide emulsion layer-side, it may be contained, for example, in a protective layer provided on a emulsion layer, an interlayer between an emulsion layer and a subbing layer or an interlayer between a first emulsion layer and a second emulsion layer. In the case when contained in a backing layer-side, it may be contained in a protective layer provided on the backing layer. An addition amount of the dye of the invention is not to be limitative but is preferably one so as to produce an effective density of 0.3 to 2. Thus, the dye is preferably contained in an amount of 0.01 to 1 g per $m^2$ of the photographic material.

In the present invention, the photographic light sensitive material preferably has a contrast of 8.0 or more. In the invention, to decrease liability to gradation variation and increase a practical density, it is effective to increase a contrast (a gamma value), which is enhanced by adding a hydrazine compound or tetrazolium compound. In the present invention, the photographic light sensitive material preferably has a contrast (gamma value) of 8.0 or more, in which the contrast or gamma value means a slope of a straight line connecting two points corresponding densities of 0.1 and 2.5 on a characteristic curve of a photographic material which has been exposed through an optical wedge with a printer, for example, P-627 (product by Dainippon Screen Co., Ltd.) and processed. In the case when the gamma value is less than 8.0, the soft gradation results in increased fringe in the periphery of a halftone dot and hence the gradation becomes liable to be varied. In the case when the gamma value is not less than 8.0, the liability to gradation variation becomes small and an exposure latitude becomes broad. The gamma value is preferably not less than 10.0, more preferably not less than 15.0.

In the present invention, it is preferable that at least one of the component layers of the silver halide photographic light sensitive material contains a hydrazine compound represented by the following formula [H],

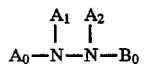

formula [H]

wherein $A_0$ represents an aliphatic group, aromatic group, or heterocyclic group, each of which may be substituted; $B_0$ represents an acyl group, alkylsulfonyl group, arylsulfonyl group, alkylsufinyl group, arylsulfinyl group, carbamoyl group, alkoxycarbonyl group, aryloxycarbonyl group, sulfamoyl group, sulfinamoyl group, alkoxysufonyl group, thiacyl group, thiocarbamoyl group, oxalyl group or heterocyclic group, provided that $B_0$ may combine with $A_2$ to form a ring; $A_1$ and $A_2$ are both a hydrogen atom, or one of them is a hydrogen atom and the other is an acyl or oxalyl group.

Preferable embodiments of a hydrazine compound represented by formula [H] is described more in detail.

An aliphatic group represented by $A_0$ of formula [H] is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfoamide, sulfamoyl, acylamino and ureido).

An aromatic group represented by $A_0$ of formula [H] is preferably a monocyclic or condensed-polycyclic aryl group such as a benzene ring or naphthalene ring.

A heterocyclic group represented by $A_0$ of formula [H] is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring.

$A_0$ is preferably an aryl group or heterocyclic group, which may be substituted.

$A_0$ contains preferably a nondiffusible group or a group for promoting adsorption to silver halide. As the nondiffusible group is preferable a ballast group used in immobile photographics additives such as a coupler. The ballast group includes an alkyl group, alkenyl group, alkynyl group, alkoxy group, phenyl group, pheoxy group and alkylpheoxy group, each of which has 8 or more carbon atoms and is photographically inert.

The group for promoting adsorption to silver halide includes a thioureido group, thiourethane, mercapto group, thioether group, thione group, heterocyclic group, thioamide group, mercapto-heterocyclic group or a adsorption group as described in JP A-64-90439.

$B_0$ is a blocking group represented by $—G_0—D_0$, wherein $G_0$ is a —CO—, —COCO—, —CS—, —C (=$NG_1D_1$)—, —SO—, —$SO_2$ — or —P(O) ($G_1D_1$)— group. $G_1$ is a linkage, or a —O—, —S— or —N($D_1$)—group, in which $D_1$ represents a hydrogen atom, or an aliphatic group, aromatic group or heterocyclic group, provided that when a plural number of $D_1$ are present, they may be the same with or different from each other.

$D_0$ represents an aliphatic group, aromatic group, heterocyclic group, amino group, alkoxy group or mercapto group.

$G_0$ is preferably a —CO— or —COCO— group, more preferably a —COCO— group.

$D_0$ is preferably a hydrogen atom, alkoxy group or amino group.

$A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

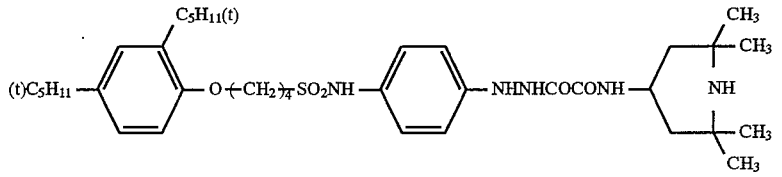

H-1

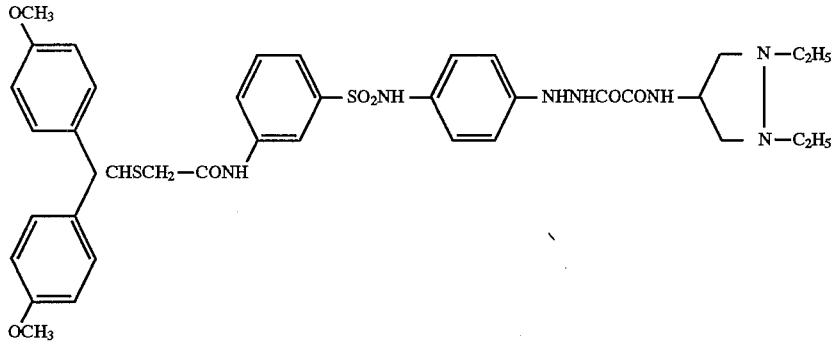

H-2

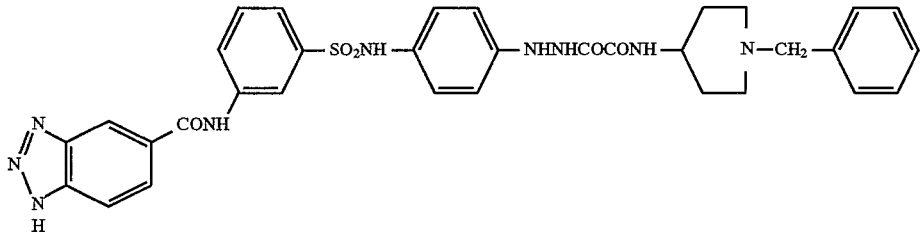

H-3

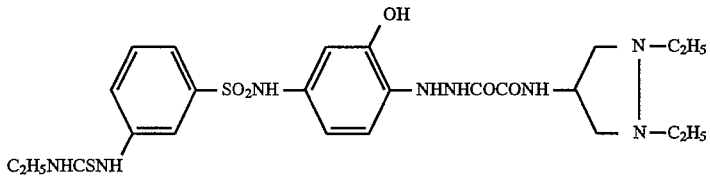

H-4

-continued
H-5
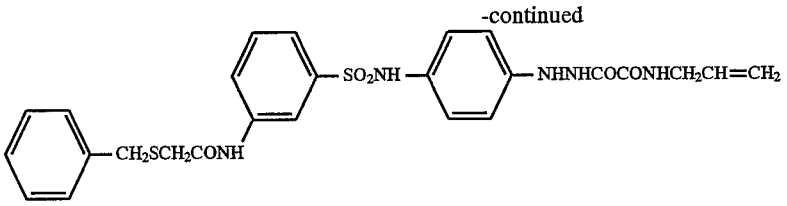
H-6
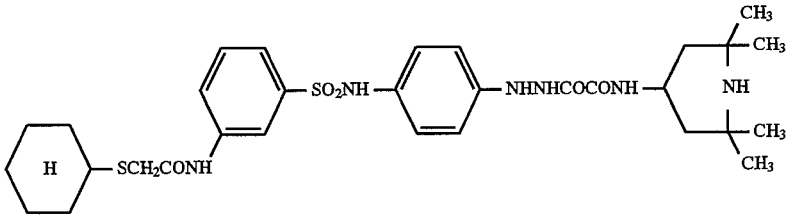
H-7
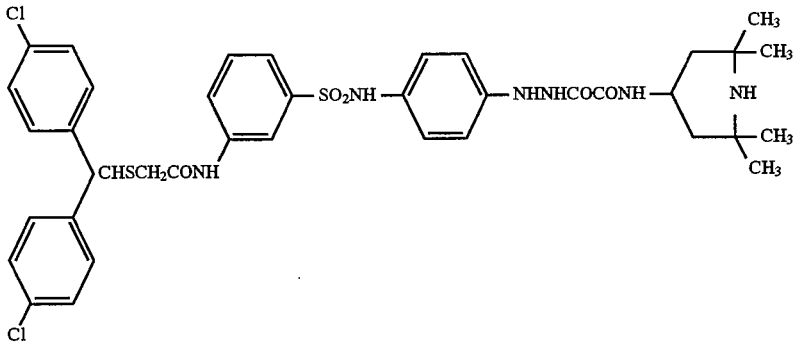
H-8
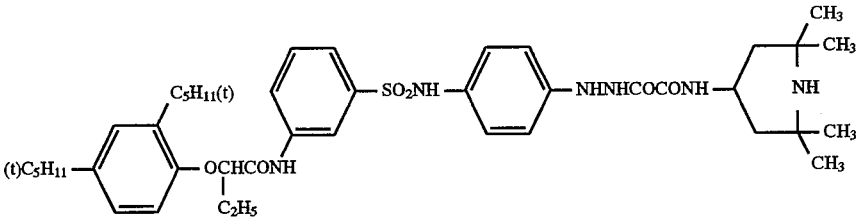
H-9
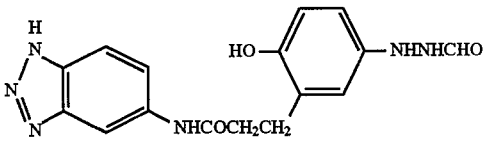
H-10
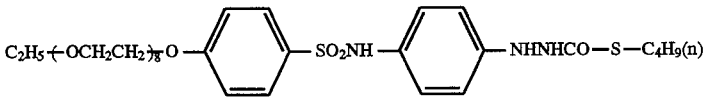
H-11
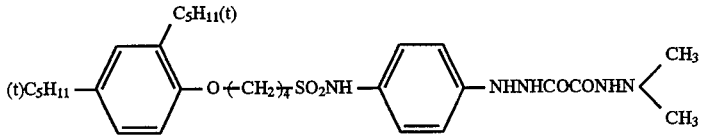
H-12
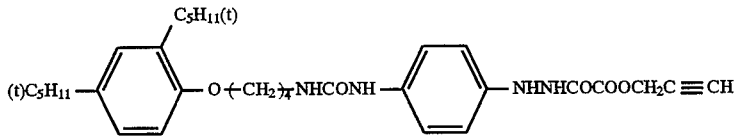
H-13
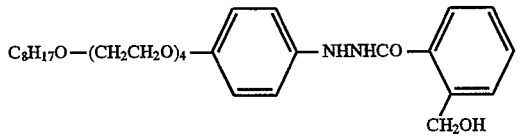

-continued
H-14
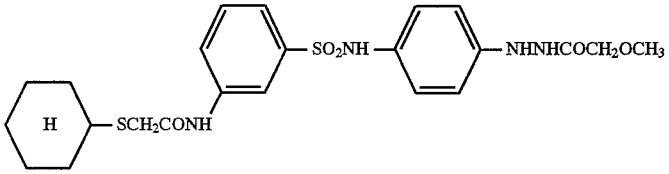
H-15
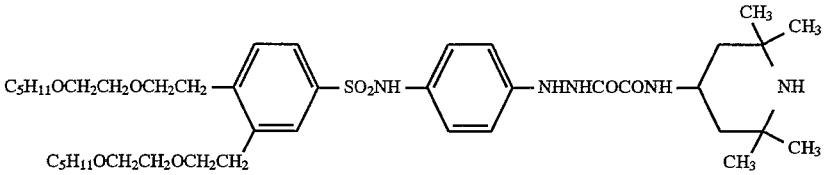
H-16
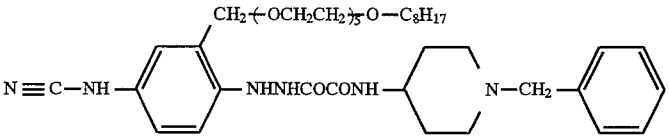
H-17
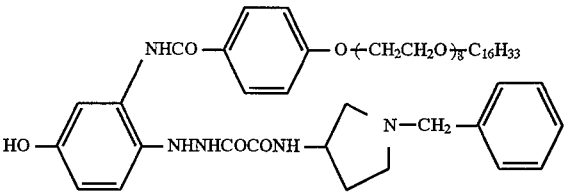
H-18
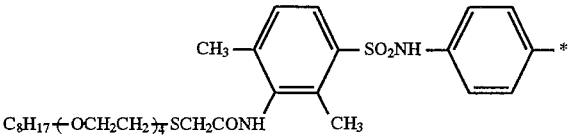
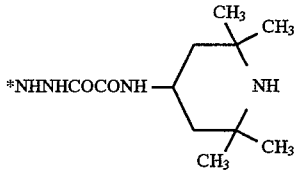
H-19
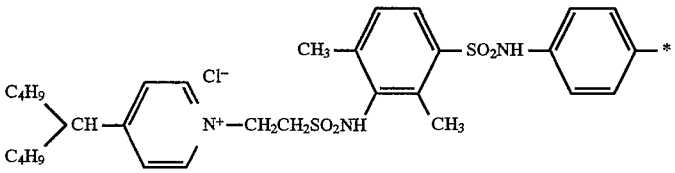
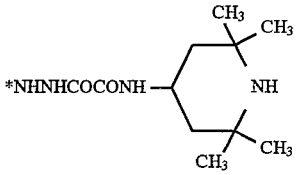
H-20
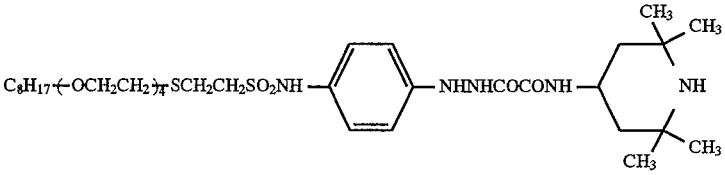

-continued

H-21

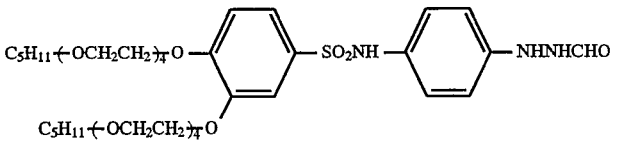

H-22

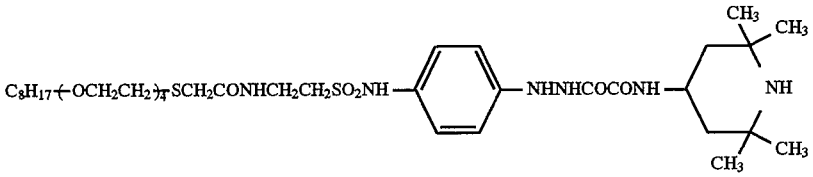

H-23

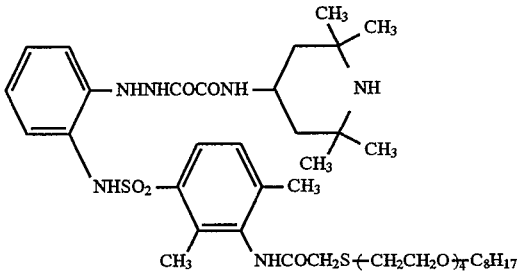

H-24

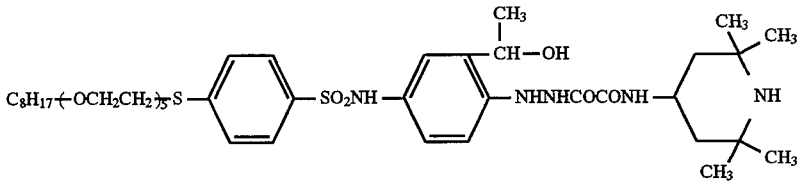

H-25

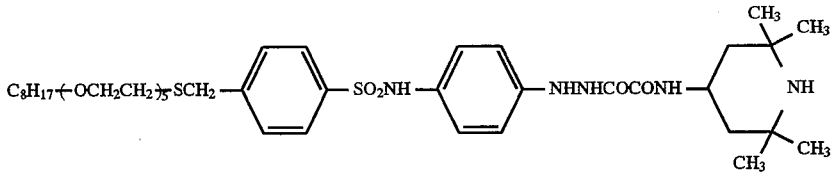

In the invention, it is preferable that at least one of the component layers of the silver halide photographic light sensitive material contains a compound represented by the following formula [T], formula [T]

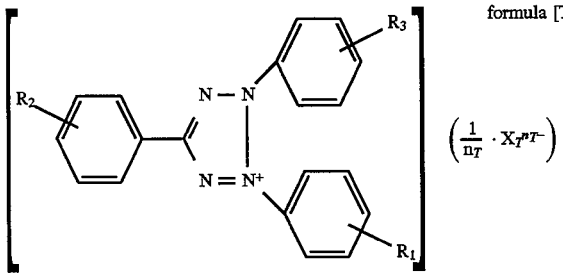

wherein $R_1$, $R_2$ and $R_3$ independently represents a hydrogen atom or a substituent; $X_T^-$ is an anion; $n_T$ is 1 or 2.

$R_1$, $R_2$ and $R_3$ of formula [T] each are preferably a hydrogen atom or a group having a negative Hammett's σ value ($\sigma_p$), which indicates an electron attractivity.

With respect to Hammett's σ values in substitution for a phenyl group disclose many references such as C. Hansch, Journal of Medical Chemistry, Vol.20, 304 (1977). Examples of preferable groups having a negative value include methyl ($\sigma_p$=−0.17, hereinafter being denoted as a $\sigma_p$ value), ethyl (−0.15), cyclopropyl (−0.21), n-propyl (−0.13), iso-propyl (0.15), cyclobutyl (−0.15), n-butyl (−0.16), iso-butyl (−0.20), n-pentyl (−0.15), cyclohexyl (−0.22), amono (−0.660, acetyl amino (−0.15), hydroxyl (−0.37), methoxy (−0.27), ethoxy (−0.24), proxy (−0.25), butoxy (−0.32) and pentoxy (−0.34). These group are usable as $R_1$, $R_2$ and $R_3$ of formula [T] of the invention.

$n_T$ is 1 or 2; an anion represented by $X_T^{nT-}$ includes a halide ion such as chloride, bromide or iodide ion, an acid radical of an inorganic acid such as nitric acid, sulfuric acid or perchloric acid; an acid radical of an organic acid such as a sulfonic acid or carboxlic acid; an anionic surfactant e.g., a lower alkylbenzenesulfonic acid anion such as p-toluenesulfonic acid anion, a higher alkylbenzenesulfonic acid anion such as p-dedecylbenzenesulfonic acid anion, a higher alkylsulfuric acid ester anion such as laurylsulfateanion, a boric acid anion such as tetraphenylborondialkylsuccinate anion such as di-2-ethylhexylsulfosuccinate anion, a polyether alcohol sulfuric acid ester anion such as cetylpolyethenoxysulfate anion, a higher aliphatic acid anion such as stearinic acid anion or a polymer with a acid radical such as polyacrylic acid anion.

Examples of the compound represented by formula [T] are shown below, but the tetrazolium compounds of the invention are not limited thereto.

TABLE 1

| Compound | $R_1$ | $R_2$ | $R_3$ | $X_T^{n+}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

A tetrazolium compound as above-described can be easily synthesized, for example, according to a method described in Chemical Review, Vol.55, 335–483.

To promote a contrast increase by a hydrazine compound, it is preferable to use a nucleation-promoting agent represented by the following formulas [Na] or [Nb].

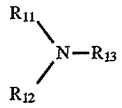

Formula [Na]

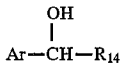

Formula [Nb]

In formula [Na], $R_{11}$, $R_{12}$ and $R_{13}$ independently represent a hydrogen atom, an alkyl group, an alkenyl group, an alkynyl group, an aryl group, each of which may be substituted. $R_{11}$, $R_{12}$ and $R_{13}$ may combine with each other to form a ring. Preferable compound is an aliphatic tertiary amine compound. The compound of formula [Na] contains preferably a ballast group or a group promoting adsorption to silver halide. As a ballast group, is preferable a group having a molecular weight of 100 or more, more preferably 300 or more. As an adsorption-promoting group, is cited a heterocyclic group, mercapto group, thioether group, thione group or thiourea group.

Examples of nucleation promoting agents of formula [Na] are shown as below.

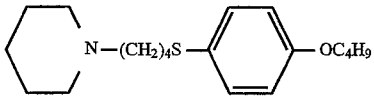

Na-1

$[(C_3H_7)_2N(CH_2)_3OCH_2CH_2]_2S$

Na-2

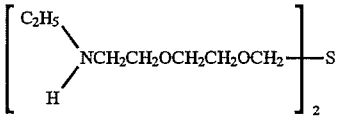

Na-3

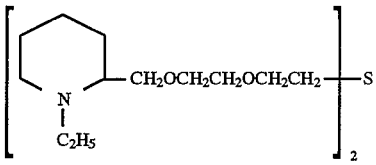

Na-4

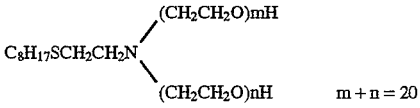

Na-5

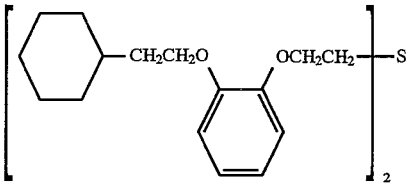

Na-6

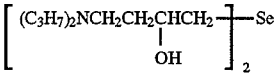

Na-7

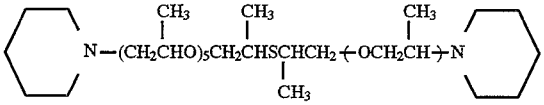

Na-8

-continued

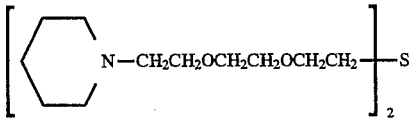

Na-9

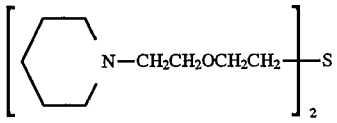

Na-10

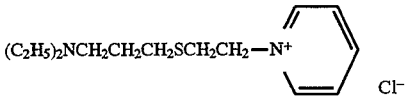

Na-11

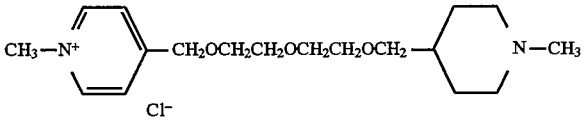

Na-12

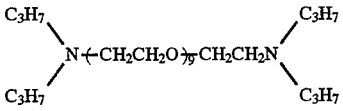

Na-13

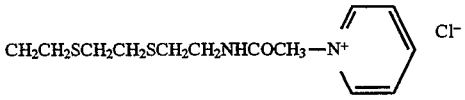

Na-14

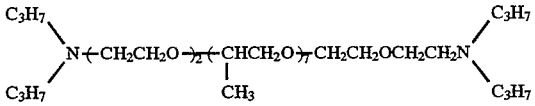

Na-15

$[(C_2H_5)_2N(CH_2)_3NHCOCH_2]_{12}Se$

Na-16

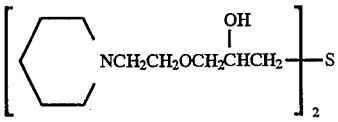

Na-17

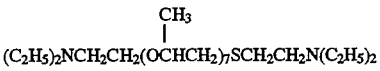

Na-18

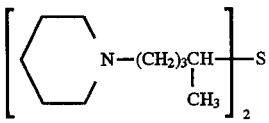

Na-19

In formula [Nb], Ar represents aryl group or heterocyclic group, each of which may be substituted; $R_{14}$ represents an alkly group, alkynyl group or aryl group and Ar and $R_{14}$ may be combined with each other to form a ring. The compound has preferably a ballst group or a group capable of adsorbing to silver halide. As a ballast group, molecular weight thereof is preferably not less than 120, more preferably not less than 300. The group capable of adsorbing to silver halide is the same as that described in the compound of formula [H].

Examples of compounds represented by formula [Nb] are cited as follows.

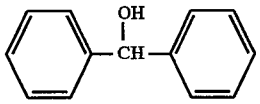

Nb-1

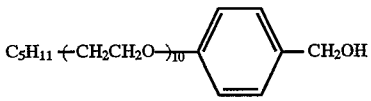

Nb-2

-continued

Nb-3

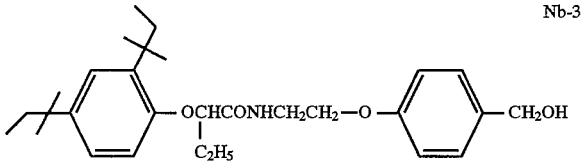

Nb-4

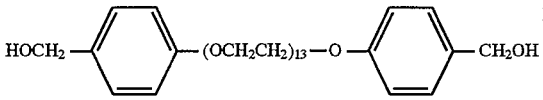

Nb-5

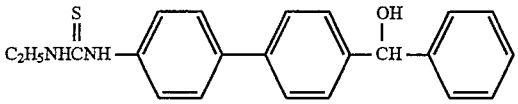

Nb-6

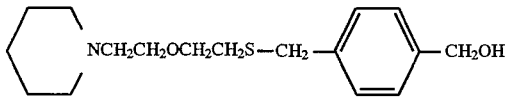

Nb-7

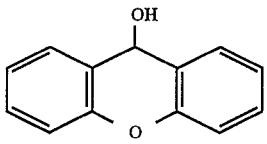

Nb-8

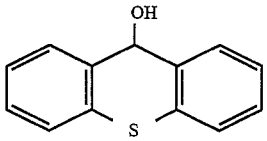

Nb-9

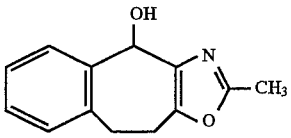

Nb-10

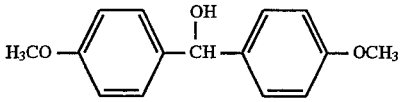

Nb-11

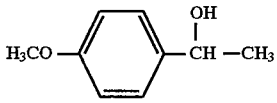

Nb-12

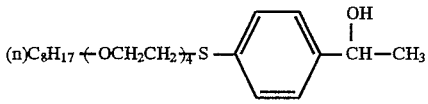

A tetrazolium compound, hydrazine compound and nucleation-promoting agent may be contained in any of layers provided on the side having a silver halide emulsion layer, and preferably in a silver halide emulsion layer or a layer adjacent thereto. An addition amount, which generally depends on silver halide grain sizes, halide composition thereof, degree of chemical ripening and kind of a restrainer, is within a range of $10^{-6}$ to $10^{-1}$ mol per mol of silver halide, preferably $10^{-5}$ to $10^{-2}$ mol per mol of silver halide.

In the present invention, a developing agent used in a developer substantially not containing a dihydroxybenzene is preferably a compound represented by the following formula [A].

Formul [A]

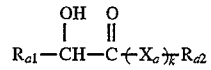

wherein $R_{a1}$ and $R_{a2}$ independently represents an alkyl group, amino group, alkoxy group or alkylthio group, each of which may be substituted, and $R_{a1}$ and $R_{a2}$ may be combined with each other to form a ring; k is 0 or 1 and when k is 1, $X_a$ is —CO—or —CS—.

The developing agent as above-described is preferably represented by the following formula [A-a].

Formula [A-a]

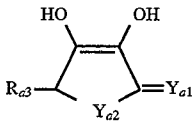

wherein $R_{a3}$ represents a hydrogen atom, an alkyl group, aryl group, amino group or alkoxy group, each of which may be substituted, or sulfonamide, carboxyl, amide or sulfonamide; $Y_{a1}$ represents O or S; $Y_{a2}$ represents O, S or $NR_{a4}$, in which $R_{a4}$ represents an alkyl group or aryl group, each of which may be substituted.

In above-described formulas [A] or [A-a], as an alkyl group is preferabe a lower alkyl group, more preferably, one having 1 to 5 carbon atoms; as an amino group is preferable a unsubstituted amino group or amino group substituted by a lower alkyl group; as an alkoxy group is preferable a lower alkoxy group; as an aryl group is preferable a phenyl group or naphthyl group, which may be substituted with hydroxy, a halogen atom, an alkoxy group, sulfo group, carboxy group, amide group or sulfonamide group.

Examples of the compound represented by formulas [A] and [A-a] are shown as below but the present invention is not limited thereto.

TABLE 2

| | Formula [A] | | |
|---|---|---|---|
| Compound | $X_a$ | $R_{a1}$ | $R_{a2}$ |
| A-1 | — (k = 0) | $HOCH_2CH(OH)—CH(OH)—$ | —OH |
| A-2 | — (k = 0) | $CH_3CH(OH)—CH(OH)—$ | —OH |
| A-3 | — (k = 0) | $HOCH_2CH(OH)—CH(OH)—$ | $—CH_3$ |
| A-4 | — (k = 0) | $CH_3CH(OH)—CH(OH)—$ | $—CH_3$ |
| A-5 | —C(=O)— (k = 1) | $HOCH_2CH(OH)—CH(OH)—$ | —OH |
| A-6 | —C(=O)— (k = 1) | $CH_3CH(OH)—CH(OH)—$ | —OH |
| A-7 | —C(=S)— (k = 1) | $HOCH_2CH(OH)—CH(OH)—$ | —OH |
| A-8 | —C(=S)— (k = 1) | $CH_3CH(OH)—CH(OH)—$ | —OH |

TABLE 2-continued

| Compound | Formula [A] $X_a$ | $R_{a1}$ | $R_{a2}$ |
|---|---|---|---|
| A-9 | $-\overset{O}{\overset{\|\|}{C}}-$ (k=1) | $HO-CH_2-$ | $-OH$ |
| A-10 | $-\overset{O}{\overset{\|\|}{C}}-$ (k=1) | $HO-CH_2-$ | $-CH_2$ |
| A-11 | $-\overset{O}{\overset{\|\|}{C}}-$ (k=1) | $HO-CH_2-$ | $-C_2H_5$ |
| A-12 | $-\overset{O}{\overset{\|\|}{C}}-$ (k=1) | $HO-CH_2-$ | $-C_2H_4OH$ |

TABLE 3

| Compound | Formula [A-a] $Y_{a1}$ | $Y_{a2}$ | $R_{a3}$ |
|---|---|---|---|
| A-13 | O | O | H |
| A-14 | O | O | $CH_3$ |
| A-15 | O | O | $CH_2$ \| OH |
| A-16 | O | O | $CH_3CH-$ \| OH |
| A-17 | O | O | $HOCH_2CH-$ \| OH |
| A-18 | O | O | $ClCH_2CH-$ \| OH |
| A-19 | O | O | $HOOCCH_2CH-$ \| OH |
| A-20 | S | O | H |
| A-21 | S | O | $CH_3CH-$ \| OH |
| A-22 | S | O | $HOCH_2CH-$ \| OH |
| A-23 | O | $NCH_3$ | H |
| A-24 | O | NH | $HOCH_2CH-$ \| OH |
| A-25 | O | S | H |
| A-26 | O | S | $HOCH_2CH-$ \| OH |
| A-27 | O | S | $CH_3CH-$ \| OH |
| A-28 | S | S | H |
| A-29 | S | S | $HOCH_2CH-$ \| OH |

TABLE 3-continued

| Compound | Formula [A-a] $Y_{a1}$ | $Y_{a2}$ | $R_{a3}$ |
|---|---|---|---|
| A-30 | S | S | H |

The compound represented by formulas [A] and [A-a] is added in an amount of 0.05 to 0.5 mole, preferably 0.1 to 0.25 mole per liter of a developer. These compounds, which are typically derivatives from ascorbic acid or erysorbic acid (isoascorbic acid) are commercially available or can be readily synthesized according to a well-known method.

As an auxiliary developing agent which exhibits super-additivity with a developing agent represented by formula [A] of are cited 3-pyrazolidone derivatives and p-aminophenol derivatives. Examples thereof are shown as below, but are not to be construed as limiting the same.

1-Phenyl-3-pyrazolidone (Phenidone)
1-Phenyl-4,4-dimethyl-3-pyrazolidone (Dimezon)
1-Phenyl-4-methyl-4-hydroxymethyl-3-pyrazolidone (Dimezon S)
1-Phenyl-5-methyl-3-pyrazolidone
1-p-Aminophenyl-4,4-dimethyl-3-pyrazolidone
1-p-tolyl-4,4-dimethyl-3-pyrazolidone
1-p -tolyl-4-methyl-4-hydroxymethyl-3-pyrazolidone
N-methyl-p-aminophenol
N-(β-hydroxyethyl)-p-aminophenol
N-(4-hydroxyphenyl)glycine
2-Methyl-p-aminophenol
p-benzylaminophenol A developer is characterized in that it does not substantially contain a dihydroxybenzene type developing agent. The term dihydroxybenzene type developing agent is represented by the following formulas V-1 to V-3.

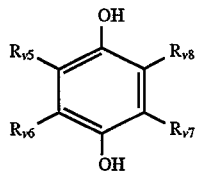

V-1

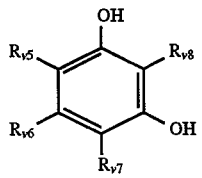

V-2

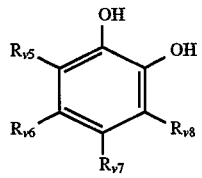

V-3 wherein $R_{V5}$, $R_{V6}$, $R_{V7}$ and $R_{V8}$ independently represent a hydrogen atom, an alkyl group, an aryl group, a carboxy group, a halogen atom or a suofo group.

Examples thereof include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, and the most popular one is hydroquinone.

In the present invention, the dihydroxybenzene compound is substantially not contained in a developer. The expression "substantially not contained" indicates that no dihydroxybenzene is contained at all or the dihydroxybenzene is contained in an amount that does not exhibits allergic action or an development effect. In the invention it is preferable that no dihydroxybenzene is contained at all.

The smaller is developer replenishing rate, the less running cost. However, when the replenishing rate is too small in a large amount processing, occurrence of silver sludge and sensitivity variations become remarkable. In the present invention, however, even when processed in large amount and at a low replenishing rate, the occurrence of silver sludge becomes smaller and the sensitivity is stable. As to the replenishing rate, an inventive effect can be sufficiently achieved at the rate of 200 cc or less per $m^2$ of photographic material and it is preferable to be 40 $cc/m^2$ or less from the view point of preventing silver sludge.

When processed with an automatic processor at a line-speed of 2000 mm/min., there is, in general, disturbed stirring in a developer tank so that uneven densities have been produced and stable processing cannot be accomplished. In the present invention, on the other hand, process stability is achieved as well as in being processed at a speed of less than 2000 mm/min. However, when processed at a speed of more than 5000 mm/min., there occur flaws on the surface of a photographic material due to rubbing friction with a transport roller.

In a black and white photographic light sensitive material of the present invention, it is preferable to provide a conductive layer on a support. A representative technique for forming the conductive layer is cited the use of a water-soluble polymer, hydrophobic polymer and hardener, or a metal oxide compound, as disclosed JP-A-3-265842 (pages 5–15).

Silver halide of a silver halide emulsion applicable in the present invention may be any of silver bromide, silver iodobromide, silver iodochloride, silver chlorobromide and silver chloride. Among these silver halides, silver bromochloride containing 50 mol % or more chloride and silver chloride are preferable.

In the invention, monodispersed silver halide grain emulsion is preferred, having 15% or less of a variation coefficient expressed as (standard deviation of grain size distribution)/(average grain size)×100 , which is determined from grain size measurement with electronmicrograph.

To the silver halide emulsion of the present invention, various technologies and additives known in the art can be used. For example, into the silver halide emulsion and backing layer(s), various chemical sensitizer, a toning agent, hadener, surfactant, thickener, plasticizer, sliding agent, development restrainer, UV absorber, anti-irradiation dye, heavy metal and matting agent can be contained by various means. In addition, a polymer latex can be contained in the silver halide emulsion and backing layer. These additives are described in detail in Research Disclosure Vol. 176, Item 17643 (December, 1978) and ibid Vol. 187, Item 18716 (November, 1979). The relevant portions are cited as below.

| Aditive | RD/7643 | RD/8716 |
|---|---|---|
| 1. Chemical sensitizer | page 23 | page 648, right column |
| 2. Sensitivity enhancement agent | | page 648, right column |
| 3. Spectral sensitizer | pages 23–24 | page 648, right column |
| Super sensitizer | | page 649, right column |
| 4. Whitening agent | page 24 | |
| 5. Anti-foggant and stabilizer | page 24–25 | page 649 right column |
| 6. Light-absorbrt, filter dye and UV absorber | page 25–26 | page 649–650 |
| 7. Anti-stain agent | page 25 | page 650 |
| 8. Dye image stabilizer | page 25 | |
| 9. Hardener | page 26 | page 651, right column |
| 10. Binder | page 26 | page 651, right column |
| 11. Olasticizer, lubricant | page 27 | page 650 right column |
| 12. Coating aid, surfactant | page 26–27 | page 650 right column |
| 13. Anti-static agent | page 27 | page 650 right column |

A support applicable in a silver halide photographic light sensitive material of the present invention includes polyester such as cellulose acetate, cellulose nitrate and polyethylene terephthalate, polyolefin such as polyethylene, polystyrene, baryta paper, polyolefin-coated paper, glass and metal. These support may be subbed, if necessary.

EXAMPLE

Examples of the invention are shown as below but the present invention is by no means limited to these.

Example 1

Synthesis of latex La:

To 40 l of water, was added 0.125 Kg of KMDS (sodium dextran sulfate) and 0.05 Kg of ammonium persulfate and further added a mixture containing the following monomer components (i)–(iii) over a period of one hour under nitrogen atmosphere, while being stirred at 80° C. After being stirred further for one and half hours, were added 1.25 Kg of KMDS and 0.005 Kg of ammonium persulfate, and stirring was continued for one and half hours. After completion of reaction, monomer remained was removed therefrom by steam distillation for one hour. Thereafter, the pH was adjusted to 6.0 with ammonia. The resulting latex solution was made to 50.0 Kg in total, comprising monodispersed particles having an average size of 0.25 μm and $T_g$ (glass transition temperature) of 0° C.

| | |
|---|---|
| (i) n-Butylacrylate | 4.51 Kg |
| (ii) Styrene | 5.49 Kg |
| (iii) Acrylic acid | 0.1 Kg |

Preparation of silver halide emulsion:

A solution containing silver nitrate and a solution containing sodium chloride, potassium bromide and rhodium hexachloride ($8\times10^{-5}$ mol/Ag mol) were simultaneously added to a gelation solution at a controlled rate. After desalting, there was obtained an emulsion comprising monodispersed silver chlorobromide cubic-crystal grains containing 1 mol % bromide and having an average grain size of 0.13 μm.

The resulting emulsion was sulfur-sensitized in a conventional manner using sodium thiosulfate in an amount as shown in Table 4. After completing chemical ripenining, was added 6-methyl-4-hydroxy-1,3,3a,7-tetrazain and then, gelatin was further added thereto so as make the total gelatin content of 1.2 g/m$^2$. The following additives were added to the emulsion to prepare a coating solution of emulsion (E-0). Furthermore, a coating solution of an emulsion protective layer (P-0), a solution of a backing layer (B-0) and a coating solution of a backing protective layer (BP-0) were prepared in accordance with the following formulas.

Coating solutions of emulsion (E-0):

| | |
|---|---|
| Compound (a) | 1 mg/m$^2$ |
| Saponin (20%) | 0.5 cc/m$^2$ |
| Sodium dodecylbenzenesulfonate | 20 mg/m$^2$ |
| 5-Methylbenzotriazole | 10 mg/m$^2$ |
| Compound (b) | 2 mg/m$^2$ |
| Compound (c) | 6 mg/m$^2$ |
| Latex La | 1.0 g/m$^2$ |
| Styrene-maleic acid copolymer (thickener) | 90 mg/m$^2$ |

The pH was adjusted to 5.6 with a NaOH solution (0.5N).

(a)

(i) (ii)

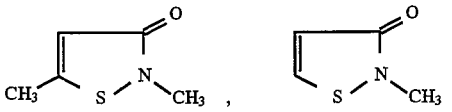

(i):(ii):(iii) = 50:46:4

(iii)

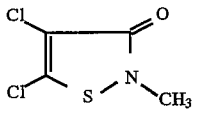

(b)

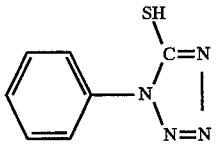

(c)

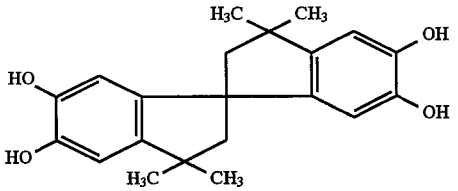

Coating solution of emulsion-protective layer (P-0):

| | |
|---|---|
| Gelatin | 1.1 g/m$^2$ |
| Compound (d) (1%) | 25 cc/m$^2$ |
| Compound (e), as shown in Table 4 | |
| Sodium p-perfluoro-4-nonenyl-benzenesulfonate | 2 mg/m$^2$ |
| Silica (monodispersed, sphere-particles, 8 μm) | 20 mg/m$^2$ |
| Silica (monodispersed, sphere-particles, 3 μm) | 10 mg/m$^2$ |
| Compound (f) | 100 mg/m$^2$ |
| Styrene/maleic acid copolymer (thickener) | 100 mg/m$^2$ |

The pH was adjusted to 6.0 with citric acid.

Coating solution of backing layer (B-0):

| | |
|---|---|
| Gelatin | 1.0 g/m$^2$ |
| Compound (g) | 100 mg/m$^2$ |
| Compound (h) | 18 mg/m$^2$ |
| Compound (i) | 100 mg/m$^2$ |
| Saponin (20%) | 0.6 cc/m$^2$ |

-continued

| | |
|---|---|
| Latex (j) | 300 mg/m$^2$ |
| 5-Nitroindazole | 20 mg/m$^2$ |
| Styrene/maleic acid copolymer (thickener) | 45 mg/m$^2$ |
| Glyoxal | 4 mg/m$^2$ |
| Compound (k) | 10 mg/m$^2$ |
| Compound (l) | 10 mg/m$^2$ |
| 5-Methylbenzotriazole | 20 mg/m$^2$ |

Coating solution of backing-protective layer (BP-0):

| | |
|---|---|
| Gelatin | 0.5 g/m$^2$ |
| Compound (d) (1%) | 2 cc/m$^2$ |
| Polymethylmetaacrylate (spere particles, 4 μm) | 25 mg/m$^2$ |
| Sodium chloride | 70 mg/m$^2$ |
| Glyoxal | 22 mg/m$^2$ |

(d)

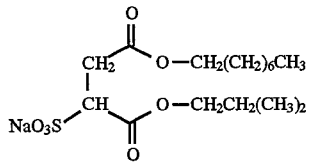

(e)

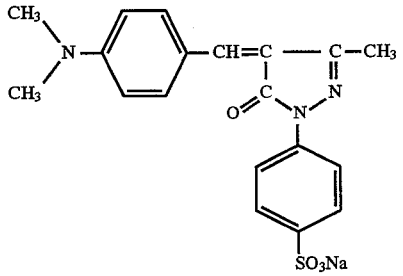

(f)

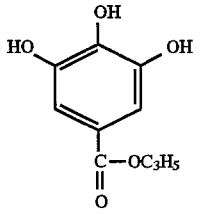

(g)

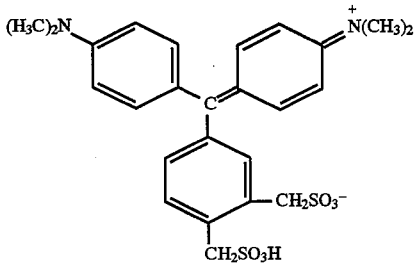

(h)

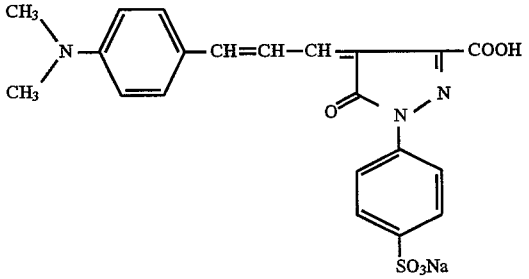

-continued

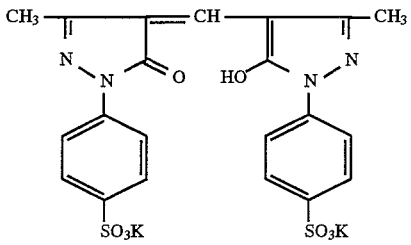

(i)

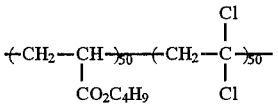

(j)

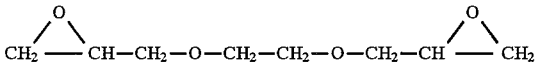

(k)

$H\text{-}(OCH_2CH_2)_n\text{-}OH$ MW = 1600 (l)

On a subbed polyethylene terephthalate film with a thickness of 100 μm which was previously subjected to corona discharge (10W/m$^2$ min.), was coated an anti-static solution having the following composition using a roll-fit coating pan and air knife. Thus coated substrate was dried at 90° C. over a period of 30 min. and thereafter subjected to a thermal treatment at 140° C. for 90 sec. to prepare a support having on one side (emulsion-side) thereof an electroconductive layer having a thickness of 1 μm and a specific surface resistance of $1\times10^8$ Ω at 23° C. and 55% R.H.

Water-soluble polymer 70 g/l

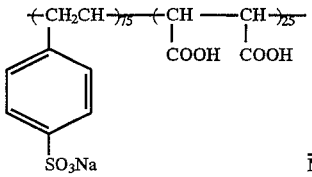

$\overline{Mw} = 5000$

Hydrophobic polymer 40 g/l

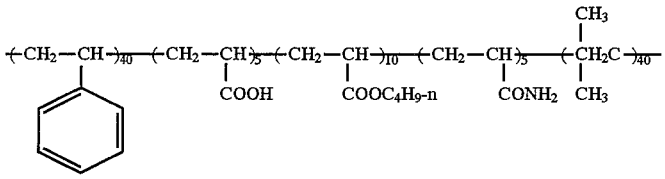

Ammonium sulfate 0.5 g/l

Polyethyleneoxide ($\overline{MW} = 60$) 6 g/l

Hardener, a mixture as shown below 12 g/l

Mixture of

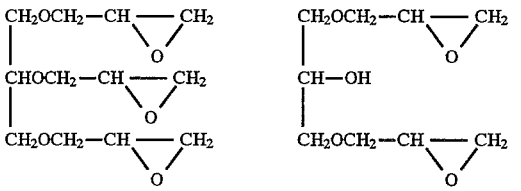

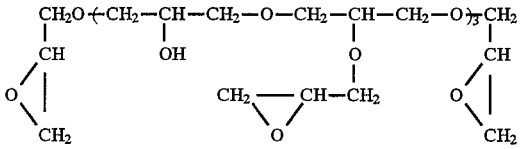

On one side of the support, an emulsion layer and emulsion-protective layer were each coated in this order by slide-hopper coating, and on the opposite side thereto, a backing layer and backing-protective layer were coated.

Compound (e) of the emulsion-protective layer which was contained in an amount as shown in Table 4 was added in the form of solid particle dispersion.

TABLE 4

| Sample No. | Sodium thiosulfate [mg/molAg] | Compound (e) [mg/m$^2$] |
|---|---|---|
| 1 | 2.0 | 90 |
| 2 | 2.0 | 90 |
| 3 | 2.5 | 90 |
| 4 | 2.5 | 120 |
| 5 | 5.0 | 110 |
| 6 | 5.0 | 120 |
| 7 | 5.0 | 130 |
| 8 | 5.0 | 140 |
| 9 | 5.5 | 110 |
| 10 | 5.5 | 120 |
| 11 | 5.5 | 130 |
| 12 | 5.5 | 140 |
| 13 | 7.0 | 110 |
| 14 | 7.0 | 120 |
| 15 | 7.0 | 130 |
| 16 | 7.0 | 140 |
| 17 | 8.0 | 110 |
| 18 | 8.0 | 140 |

Evaluation

Dot percentage:

A transparent original having a dot area percentage of 50% was allowed to make contact with a photographic material sample and exposed to light using a printer, P-627 produced by Dainippon Screen Co., Ltd. A halftone dot image-side of the original was allowed to be in contact with an emulsion layer-side of the sample. There was determined the percentage of a halftone dot area formed when exposed to light in two times an exposure amount that gave a halftone dot image having a dot area of 50%.

Gamma value:

A photographic material sample, which was exposed through an optical wedge and processed, was then subjected to sensitometry using a densitometer, PDA 65 produced by Konica. A gamma value (γ) indicating a contrast was denoted as a slope of a straight line that connects two points corresponding to densities of 0.1 and 2.5 on a characteristic curve.

Sensitivity variation:

Samples were each developed with a fresh developing solution or a exhausted developing solution in running-processing, a ratio of sensitivity difference between the fresh solution and exhausted solution to a sensitivity at the fresh solution was expressed as a sensitivity variation. In any of all samples, the sensitivity obtained with the exhausted developing solution was lower as compared to that with the fresh developing solution. As the exhausted developing solution was used a developing solution at the time after 1000 pieces of photographic arts films ( RC100E, product of Konica) having a size of 508 mm×610 mm were developed at a replenishing rate of 240 cc/m$^2$.

Dot quality:

Samples used in the evaluation of the dot percentage as above were also observed with a 100 times magnifier. The dot quality was visually evaluated based on five grades. Thus, "5" is the best level, "3" is a lower limit for practical use and "1" is a level of being impractical.

Safelight sensitivity:

Samples, which were exposed in an amount that gave a halftone dot having a dot area of 50% were further exposed to light of 300 lux under a Toshiba UV-cut type fluorescent lamp so as to form a 52% dot. The exposing time required to form the 52% dot was referred to a safelight sensitivity.

Samples were processed with a processor, GR-27 (product of Konica) in accordance with the following conditions.

Processing conditions:

| Step | Temp. | Time |
|---|---|---|
| Develoing | 28° C. | 30 sec. |
| Fixing | 28° C. | 20 sec. |
| Washing | Ordinary temperature | 15 sec. |
| Drying | 40° C. | 35 sec. |

| Developer Composition A | |
|---|---|
| Deionized water | 150 ml |
| Sodium ethlenediaminetetraacetate | 2 g |
| Diethylene glycol | 50 g |
| Potassium sulfite (55% solution) | 100 ml |
| Potassium carbonate | 50 g |
| Hydroquinone | 15 g |
| 5-Methylbenzotriazole | 200 mg |
| 1-Phenyl-5-mercaptotetrazole | 30 mg |
| Potassium bromide | 4.5 g |

NaOH, An amount required to adjust the pH of a working solution to 10.4 or 11.0.

| Composition B | |
|---|---|
| Deionized water | 3 ml |
| Diethylene glycol | 50 mg |
| Sodium ethlenediaminetetraacetate | 25 mg |
| Acetic acid (90% aq. solution) | 0.3 ml |
| 5-Nitroindazole | 110 mg |
| 1-Phenyl-3-pyrazolidone | 500 mg |

When using a developer, compositions A and B were dissolved in 500 ml of water and water was further added thereto to make 1 liter. The pH of the developer was adjusted to 10.4 or 11.0.

| Fixer | |
|---|---|
| Composition A: | |
| Ammonium thiosulfate (72.5 aq. solution) | 230 ml |
| Sodium sulfite | 5.6 g |
| Sodium acetate trihydrate | 27.8 g |
| Boric acid | 9.8 g |
| Sodium citrate dihydrate | 2.0 g |
| Acetic acid (90% aq. solution) | 6.4 ml |
| Composition B | |
| Deionized water | 28 ml |
| Sulfuric acid (50% solution) | 6.7 g |
| Aluminium sulfate | 25.31 g |

At the time when using the fixer, compositions A and B were dissolver in 500 ml of water in this order and water was further added thereto to make 1 liter. The pH of the fixer was 4.4.

Results are shown in Table 5.

TABLE 5

| Sample No. | Dot % | γ | Max. density | pH of developer | Sensitivity variation (%) | Dot quality | Safelight safety (min.) | Remarks |
|---|---|---|---|---|---|---|---|---|
| 1 | 60.0 | 6.0 | 2.5 | 11.0 | 50 | 2 | 15 | Comp. |
| 2 | 60.0 | 6.1 | 2.6 | 10.4 | 45 | 2 | 17 | Comp. |
| 3 | 61.0 | 6.1 | 3.1 | 11.0 | 42 | 2 | 16 | Comp. |
| 4 | 60.0 | 8.2 | 2.4 | 11.0 | 40 | 2 | 18 | Comp. |
| 5 | 57.0 | 6.3 | 2.6 | 11.0 | 46 | 2 | 18 | Comp. |
| 6 | 60.1 | 5.9 | 4.0 | 10.4 | 41 | 3 | 19 | Comp. |
| 7 | 60.0 | 8.3 | 2.6 | 10.4 | 40 | 3 | 16 | Comp. |
| 8 | 56.9 | 6.5 | 2.6 | 10.4 | 45 | 3 | 13 | Comp. |
| 9 | 60.4 | 8.3 | 3.9 | 11.0 | 47 | 3 | 14 | Comp. |
| 10 | 56.8 | 7.0 | 4.0 | 11.0 | 45 | 3 | 17 | Comp. |
| 11 | 56.9 | 8.8 | 2.8 | 11.0 | 44 | 3 | 18 | Comp. |
| 12 | 59.8 | 8.9 | 3.8 | 10.4 | 39 | 3 | 20 | Comp. |
| 13 | 56.7 | 8.7 | 2.8 | 10.4 | 40 | 3 | 19 | Comp. |
| 14 | 56.6 | 7.3 | 4.2 | 10.4 | 37 | 3 | 16 | Comp. |
| 15 | 56.4 | 8.9 | 4.0 | 11.0 | 38 | 3 | 15 | Comp. |
| 16 | 57.0 | 8.0 | 3.0 | 10.4 | 28 | 4 | 34 | Inv. |
| 17 | 54.4 | 9.4 | 4.2 | 10.4 | 26 | 4 | 38 | Inv. |
| 18 | 54.6 | 9.2 | 5.1 | 10.4 | 25 | 5 | 40 | Inv. |

As can be seen from Table 5, the present invention was small in sensitivity variation due to developer exhaustion, excellent in dot quality and safelight safety characteristics.

Example 2

Samples were prepared in a similar manner to Sample 2 of Example 1, provided that 2.7 mg/Ag mol of sodium thiosulfate was used in chemical sensitization. Furthermore, as shown in Table 6, a hydrazine compound of 500 mg/Ag mol or a tetrazolium compound of 1 g/Ag mol was added to an emulsion layer and a dye of 60 mg/m$^2$ was added, in the form of a solid particle dispersion, to a protective layer. There was further added a nucleation-promoting agent, Na-10 of 500 mg/m$^2$ along with the hydrazine compound. Samples thus prepared were each subjected to exposure and processing and evaluated in the same manner as in Example 1. Results thereof are summarized in Table 6.

As can be seen from Table 6, when adding a hydrazine compound, tetrazolium compound or dye in the form of solid particle dispersion, the inventive samples were shown to be small in sensitivity variation due to developer exhaustion and excellent in dot quality and safelight safety characteristics.

Example 3

Samples used in Example 2 were processed in the same manner as in Example 2, except that hydroquinone used in a developer was replaced by a compound, A-17 (0.2 mol/1). Results thereof are shown in Table 7.

TABLE 6

| Sample No. | Dot % | γ | Max. density | pH of developer | Compound [H] | Compound [T] | Dye | Sensitivity variation (%) | Dot quality | Safelight safety (min.) | Remarks |
|---|---|---|---|---|---|---|---|---|---|---|---|
| 21 | 59.8 | 6.8 | 2.7 | 11.0 | | | | 46 | 2 | 17 | Comp. |
| 22 | 56.6 | 8.7 | 4.3 | 11.0 | H-7 | | | 40 | 3 | 14 | Comp. |
| 23 | 56.6 | 8.6 | 4.3 | 11.0 | | T-7 | | 39 | 3 | 16 | Comp. |
| 24 | 56.3 | 8.2 | 4.1 | 11.0 | | | 1-2 | 38 | 3 | 19 | Comp. |
| 25 | 56.6 | 8.7 | 4.3 | 10.4 | | | | 26 | 4 | 33 | Inv. |
| 26 | 56.6 | 15.5 | 4.7 | 10.4 | H-7 | | | 20 | 4 | 31 | Inv. |
| 27 | 56.6 | 13.7 | 4.8 | 10.4 | | T-7 | | 21 | 4 | 40 | Inv. |
| 28 | 56.5 | 9.2 | 4.0 | 10.4 | | | 1-2 | 22 | 4 | 45 | Inv. |
| 29 | 55.2 | 15.2 | 5.0 | 10.4 | H-8 | | | 19 | 5 | 32 | Inv. |
| 30 | 54.8 | 15.6 | 4.8 | 10.4 | H-7 | | | 20 | 4 | 34 | Inv. |
| 31 | 54.7 | 13.9 | 4.5 | 10.4 | | T-7 | | 18 | 5 | 43 | Inv. |
| 32 | 55.2 | 14.3 | 4.5 | 10.4 | | T-2 | | 16 | 5 | 45 | Inv. |
| 33 | 55.1 | 11.3 | 4.9 | 10.4 | | | 1-19 | 20 | 4 | 46 | Inv. |
| 34 | 54.3 | 10.6 | 4.3 | 10.4 | | | 1-16 | 21 | 5 | 44 | Inv. |
| 35 | 54.4 | 15.4 | 4.6 | 10.4 | H-8 | T-7 | | 18 | 4 | 31 | Inv. |
| 36 | 54.3 | 15.1 | 4.3 | 10.4 | H-7 | T-2 | | 19 | 4 | 33 | Inv. |
| 37 | 54.5 | 14.2 | 4.4 | 10.4 | H-8 | | 1-2 | 21 | 5 | 34 | Inv. |
| 38 | 54.3 | 14.5 | 4.7 | 10.4 | H-7 | | 1-19 | 20 | 5 | 33 | Inv. |
| 39 | 55.1 | 14.6 | 4.6 | 10.4 | | T-7 | 1-16 | 17 | 5 | 48 | Inv. |
| 40 | 55.2 | 14.6 | 4.5 | 10.4 | | T-2 | 1-2 | 18 | 5 | 50 | Inv. |
| 41 | 54.6 | 15.2 | 4.5 | 10.4 | H-8 | T-7 | 1-19 | 19 | 4 | 40 | Inv. |
| 42 | 54.8 | 15.0 | 4.7 | 10.4 | H-7 | T-2 | 1-16 | 20 | 4 | 42 | Inv. |

TABLE 7

| Sample No. | Dot % | γ | Max. density | pH of developer | Compound [H] | Compound [T] | Dye | Sensitivity variation (%) | Dot quality | Safelight safety (min.) | Remarks |
|---|---|---|---|---|---|---|---|---|---|---|---|
| 21 | 59.5 | 6.9 | 2.9 | 11.0 | | | | 43 | 2 | 18 | Comp. |
| 22 | 56.4 | 8.8 | 4.1 | 11.0 | H-7 | | | 41 | 3 | 15 | Comp. |
| 23 | 56.2 | 8.7 | 4.2 | 11.0 | | T-7 | | 38 | 3 | 16 | Comp. |
| 24 | 56.7 | 8.4 | 4.2 | 11.0 | | | 1-2 | 36 | 3 | 19 | Comp. |
| 25 | 56.4 | 8.7 | 4.6 | 10.4 | | | | 25 | 4 | 34 | Inv. |
| 26 | 56.4 | 15.3 | 4.8 | 10.4 | H-7 | | | 18 | 4 | 34 | Inv. |
| 27 | 56.4 | 13.8 | 4.6 | 10.4 | | T-7 | | 20 | 4 | 41 | Inv. |
| 28 | 56.3 | 9.4 | 4.1 | 10.4 | | | 1-2 | 20 | 4 | 47 | Inv. |
| 29 | 55.1 | 15.0 | 5.1 | 10.4 | H-8 | | | 17 | 5 | 34 | Inv. |
| 30 | 54.7 | 15.4 | 4.7 | 10.4 | H-7 | | | 19 | 4 | 35 | Inv. |
| 31 | 54.5 | 13.8 | 4.3 | 10.4 | | T-7 | | 17 | 5 | 44 | Inv. |
| 32 | 55.1 | 14.4 | 4.4 | 10.4 | | T-2 | | 15 | 5 | 46 | Inv. |
| 33 | 55.0 | 11.6 | 4.8 | 10.4 | | | 1-19 | 17 | 4 | 49 | Inv. |
| 34 | 54.1 | 10.4 | 4.2 | 10.4 | | | 1-16 | 19 | 5 | 46 | Inv. |
| 35 | 54.3 | 15.6 | 4.7 | 10.4 | H-8 | T-7 | | 15 | 4 | 35 | Inv. |
| 36 | 54.2 | 15.4 | 4.4 | 10.4 | H-7 | T-2 | | 16 | 4 | 37 | Inv. |
| 37 | 54.3 | 14.1 | 4.5 | 10.4 | H-8 | | 1-2 | 20 | 5 | 35 | Inv. |
| 38 | 54.2 | 14.7 | 4.6 | 10.4 | H-7 | | 1-19 | 18 | 5 | 37 | Inv. |
| 39 | 55.0 | 14.8 | 4.7 | 10.4 | | T-7 | 1-16 | 16 | 5 | 49 | Inv. |
| 40 | 55.1 | 14.5 | 4.6 | 10.4 | | T-2 | 1-2 | 16 | 5 | 53 | Inv. |
| 41 | 54.5 | 15.6 | 4.6 | 10.4 | H-8 | T-7 | 1-19 | 15 | 4 | 44 | Inv. |
| 42 | 54.8 | 15.1 | 4.8 | 10.4 | H-7 | T-2 | 1-16 | 18 | 4 | 45 | Inv. |

As can be seen from Table 7, in the present invention, the use of a developer not containing a dihydroxybenzene led to improved results in the sensitivity variation, dot quality and safelight safety characteristics.

Example 4

Samples of Example 2 were also processed and evaluated in the same manner as in Example 2, provided that 1200 pieces of photographic art films RC100E (product of Konica) of 508 mm×610 mm in size were running-processed at a developer replenishing rate of 200 cc/m$^2$ and at a line-speed of the processor of 1800 or 2100 mm/min. Results thereof are shown in Table 8.

TABLE 8

| | Replenishing 200 cc/m$^2$; Line-speed 1800 mm/min | | | Replenishing 200 cc/m$^2$; Line-speed 2100 mm/min | | | |
|---|---|---|---|---|---|---|---|
| Sample No. | Sensitivity variation (%) | Dot quality | Safelight safety (min.) | Sensitivity variation (%) | Dot quality | Safelight safety (min.) | Remarks |
| 21 | 60 | 2 | 17 | 70 | 1 | 18 | Comp. |
| 22 | 57 | 2 | 14 | 66 | 1 | 15 | Comp. |
| 23 | 56 | 2 | 15 | 64 | 2 | 16 | Comp. |
| 24 | 55 | 2 | 18 | 62 | 2 | 19 | Comp. |
| 25 | 27 | 4 | 33 | 27 | 4 | 34 | Inv. |
| 26 | 21 | 4 | 33 | 22 | 4 | 34 | Inv. |
| 27 | 23 | 4 | 41 | 22 | 4 | 42 | Inv. |
| 28 | 22 | 4 | 46 | 21 | 4 | 45 | Inv. |
| 29 | 20 | 4 | 44 | 18 | 4 | 45 | Inv. |
| 30 | 21 | 4 | 35 | 19 | 4 | 36 | Inv. |
| 31 | 19 | 4 | 43 | 19 | 4 | 44 | Inv. |
| 32 | 20 | 4 | 45 | 21 | 4 | 44 | Inv. |
| 33 | 18 | 4 | 47 | 19 | 4 | 46 | Inv. |
| 34 | 20 | 4 | 45 | 21 | 4 | 47 | Inv. |
| 35 | 21 | 4 | 34 | 21 | 4 | 35 | Inv. |
| 36 | 19 | 4 | 36 | 20 | 4 | 37 | Inv. |
| 37 | 18 | 5 | 34 | 19 | 4 | 36 | Inv. |
| 38 | 19 | 5 | 35 | 18 | 4 | 37 | Inv. |
| 39 | 20 | 4 | 48 | 21 | 4 | 47 | Inv. |
| 40 | 21 | 4 | 52 | 20 | 4 | 50 | Inv. |
| 41 | 18 | 4 | 43 | 19 | 4 | 45 | Inv. |
| 42 | 20 | 4 | 43 | 20 | 4 | 46 | Inv. |

As can be seen from Table 8, even when the line-speed was increased, inventive samples were shown to be small in the sensitivity variation due to developer exhaustion and excellent in dot quality and safelight safety characteristics.

It was further shown that in any of the case when developed with a developer containing no hydroxybenzene at a replenishing rate of 200 cc/m$^2$, developed at a replenishing rate of 240 cc/m$^2$ and a line speed of 2100 mm/min. and developed with a developer containing no hydroxybenzene at a replenishing rate of 200 cc/m$^2$ and a line speed of 2100 mm/min., the constitution of the invention resulted in improvements in the sensitivity variation, dot quality and safelight safety.

What is claimed is:

1. An image forming method for a silver halide photographic material comprising the steps of:

contacting the photographic material with a transparent original, exposing the photographic material through the transparent original to light having an emission peak at a wavelength of 360 to 450 nm, developing the exposed photographic material with a developer having a pH of 10.5 or less and not containing a dihydroxybenzene and fixing the developed photographic material with a fixer, wherein the photographic material comprises a support having thereon a silver halide emulsion layer;

the photographic material is capable of forming a halftone dot image having a dot area of 57% or less when exposed, through the transparent original comprising a halftone dot image having a dot area percentage of 50%, in two times an amount that forms a halftone dot having a dot area of 50%, and processed;

and the photographic material is capable of having a maximum density of 3.0 or more and a contrast of 8.0 or more when exposed through an optical wedge and processed; provided that the photographic material is processed under the conditions specified below;

Conditions of development and subsequent processing:

| Step | Temperature | Time |
|---|---|---|
| Developing | 28° C. | 30 sec. |
| Fixing | 28° C. | 20 sec. |
| Washing | Ordinary temperature | 15 sec. |
| Drying | 40° C. | 35 sec. |

| Developer | |
|---|---|
| Composition A | |
| Deionized water | 150 ml |
| Sodium ethylenediaminetetraacetate | 2 g |
| Diethylene glycol | 50 g |
| Potassium sulfite (55% solution) | 100 ml |
| Potassium carbonate | 50 g |
| 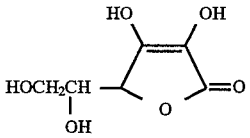 | 35 g |
| 5-Methylbenzotriazole | 200 mg |
| 1-Phenyl-5-mercaptotetrazole | 30 mg |
| Potassium bromide | 4.5 g |
| Composition B | |
| Deionized water | 3 ml |
| Diethylene glycol | 50 mg |
| Sodium ethylenediaminetetraacetate | 25 mg |
| Acetic acid (90% aq. solution) | 0.3 ml |
| 5-Nitroindazole | 110 mg |
| 1-Phenyl-3-pyrazolidone | 500 mg |

where compositions A and B are dissolved in 500 ml of water and water is further added thereto to make 1 liter, and the pH of the developer is adjusted to 10.4;

| Fixer | |
|---|---|
| Composition A | |
| Ammonium thiosulfate (72.5 aq. solution) | 230 ml |
| Sodium sulfite | 5.6 g |
| Sodium acetate trihydrate | 27.8 g |
| Boric acid | 9.8 g |
| Sodium citrate dihydrate | 2.0 g |
| Acetic acid (90% aq. solution) | 6.4 ml |
| Composition B | |
| Deionized water | 28 ml |
| Sulfuric acid (50% solution) | 6.7 g |
| Aluminum sulfate | 25.31 g |

where compositions A and B are dissolved in 500 ml of water and water is further added thereto to make 1 liter, and the pH of the fixer is adjusted to 4.4.

2. The image forming method of claim 1, wherein the photographic material further comprises at least one component layer on said support containing a compound represented by the following formula (H),

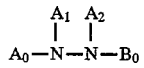

formula [H]

wherein $A_0$ represents an aliphatic group, aromatic group, or heterocyclic group, each of which may be substituted; $B_0$ represents an acyl group, alkylsulfonyl group, arylsulfonyl group, alkylsulfinyl group, arylsulfinyl group, carbamoyl group, alkoxycarbonyl group, aryloxycarbonyl group, sulfamoyl group, sulfinamoyl group, alkoxysufonyl group, thioacyl group, thiocarbamoyl group, oxalyl group or heterocyclic group, provided that $B_0$ may combine with $A_2$ to form a ring; $A_1$ and $A_2$ are both a hydrogen atom, or one of them is a hydrogen atom and the other is an acyl or oxalyl group.

3. The image forming method of claim 1, wherein the photographic material further comprises at least one component layer on said support containing a compound represented by the following formula (T),

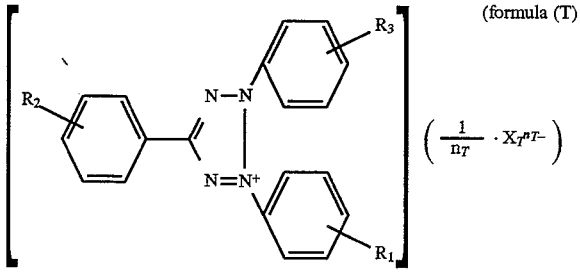

(formula (T)

wherein $R_1$, $R_2$ and $R_3$ independently represents a hydrogen atom or a substituent; $X_T^-$ is an anion; $n_T$ is 1 or 2.

4. The image forming method of claim 1, wherein the photographic material further comprises at least one component layer on said support containing a compound represented by the following formulas (1), (2), (3), (4), (5) or (6), $$A{=}L_1{\leftarrow}L_2{=}L_3{\rightarrow}_m Q \qquad \text{formula (1)}$$

$$A{=}L_1{\leftarrow}L_2{=}L_3{\rightarrow}_n A' \qquad \text{formula (2)}$$

$$A{\leftarrow}L_1{-}L_2{\rightarrow}_p B \qquad \text{formula (3)}$$

-continued formula (4)

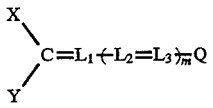

formula (5)

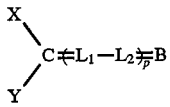

formula (6)

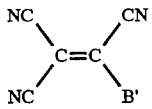

wherein A and A', which may be the same as or different from each other, are an acidic nucleus; Q represents an aryl group or heterocyclic group; B is a basic group; B' is a heterocyclic group; X and Y, which may be the same as or different from each other are each an electron-attractive group; $L_1$, $L_2$ and $L_3$ are each a methine group; m is 0 or 1; n is 0, 1 or 2; p is 1 or 2, provided that a dye represented by formula (1) through (6) contains, in a molecule thereof, at least one group selected from the group consisting of a carboxy group, sufonamide group and sulfamoyl group.

5. The image forming method of claim 4, wherein said compound is contained in the form of solid particles dispersed in a binder.

* * * * *